United States Patent [19]

Rodgers, Jr.

[11] 4,282,642

[45] Aug. 11, 1981

[54] METHOD OF MAKING COMPOSITE RACQUET CONSTRUCTION

[76] Inventor: Robert E. Rodgers, Jr., 5455 Loch Lomond, Houston, Tex. 77096

[21] Appl. No.: 90,291

[22] Filed: Nov. 1, 1979

[51] Int. Cl.[3] ..... B21D 35/00

[52] U.S. Cl. ..... 29/469.5; 29/423; 29/526 R; 264/269; 264/234; 273/73 C; 273/73 H; 273/73 J

[58] Field of Search ..... 29/469.5, 423, 526 R; 273/73 C, 73 H, 73 J, 67 R, 67 B; 264/263, 267, 269, 234

[56] References Cited

U.S. PATENT DOCUMENTS

| | | | |
|---|---|---|---|
| 1,937,787 | 12/1933 | Robinson | 273/73 H |
| 1,942,479 | 1/1934 | Kleinman | 273/73 C UX |
| 2,171,223 | 8/1939 | Robinson | 273/73 H |
| 3,311,960 | 4/1967 | Kessler | 29/469.5 X |
| 3,397,518 | 8/1968 | Rogers | 264/263 X |
| 3,612,526 | 10/1971 | Brull | 273/73 C |
| 3,625,512 | 12/1971 | Latham | 273/73 C |
| 3,702,701 | 11/1972 | Vaughn et al. | 273/73 C X |
| 3,825,646 | 7/1974 | Delmotte | 264/263 X |
| 4,031,601 | 6/1977 | Staub | 264/267 X |
| 4,066,260 | 1/1978 | Rodgers, Jr. | 273/73 C |

FOREIGN PATENT DOCUMENTS

| | | | |
|---|---|---|---|
| 2310778 | 12/1976 | France | 273/73 H |

*Primary Examiner*—Charlie T. Moon
*Attorney, Agent, or Firm*—Gunn, Lee & Jackson

[57] ABSTRACT

A racquet for use in racquet sports is disclosed. In the preferred and illustrated embodiment, a composite racquet construction is set forth which utilizes an extruded metal frame which accepts multilayered, laminated, fiber reinforced, resin material typically including an epoxy base with graphite or fiberglass therein. The extruded section receives the laminate material prior to curing wherein the metal extruded section serves as a mold. After curing, the composite frame has improved properties over the metal extrusion, alone, and enhances frame strength, rigidity and flexure characteristics. The extruded frame incorporates a central webbing which is subsequently drilled with holes for stringing the racquet.

10 Claims, 9 Drawing Figures

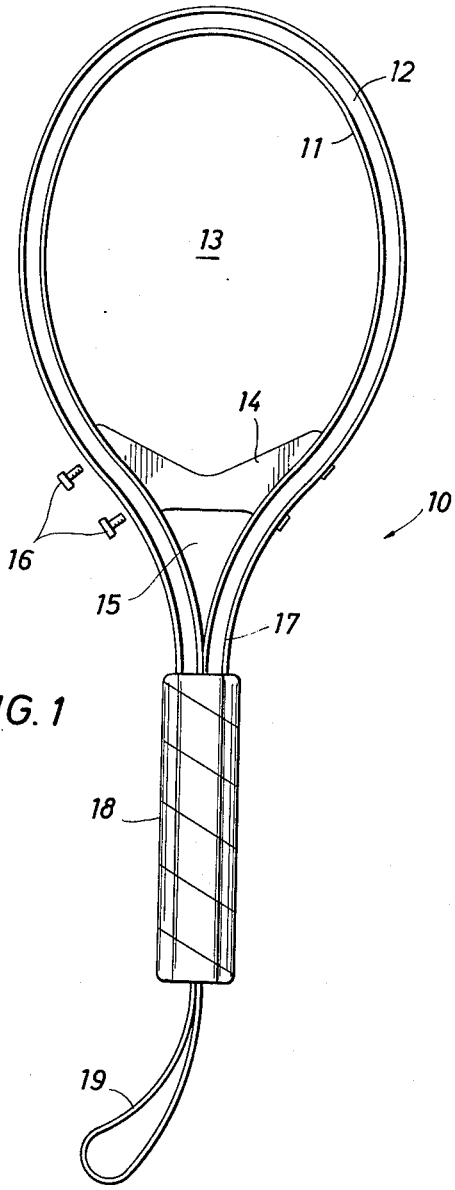
FIG. 1
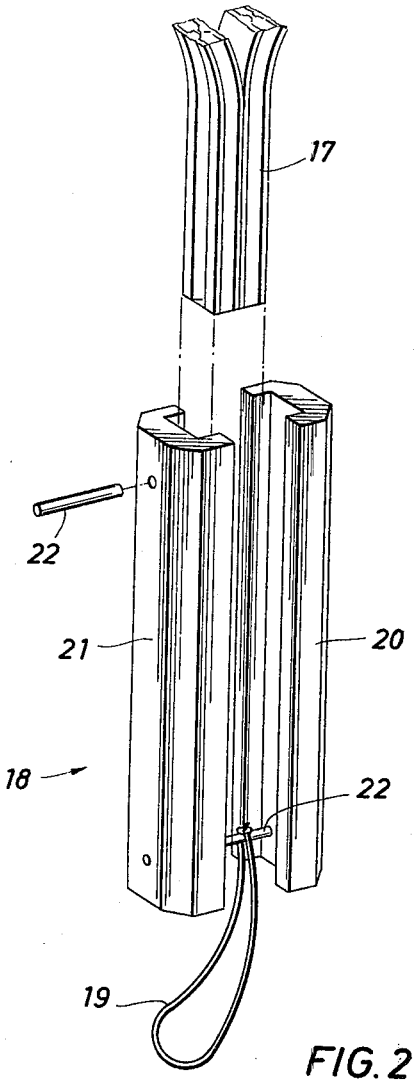
FIG. 2
FIG. 3
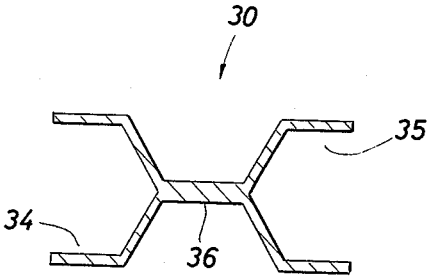
FIG. 4
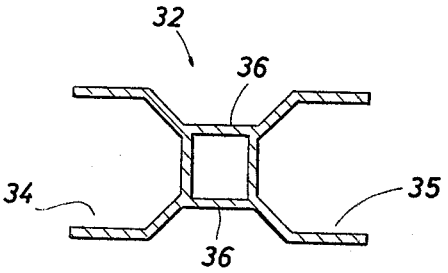

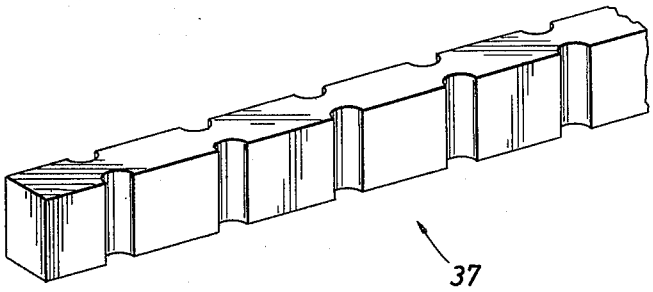
FIG. 5
FIG. 6
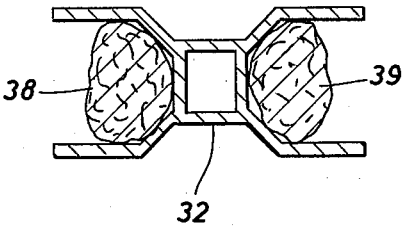
FIG. 7
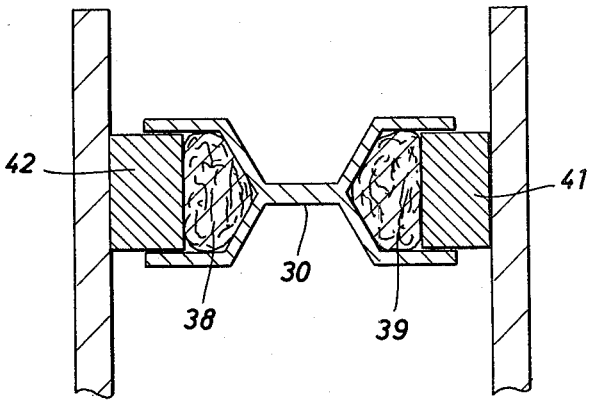
FIG. 8
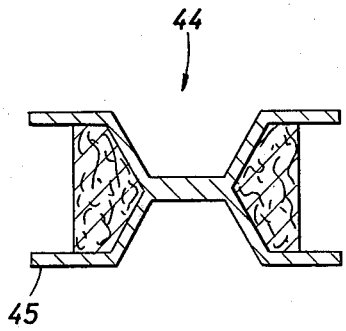
FIG. 9
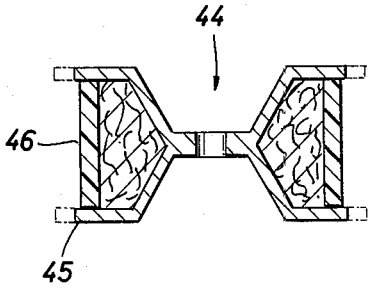

METHOD OF MAKING COMPOSITE RACQUET CONSTRUCTION

BACKGROUND OF THE DISCLOSURE

This disclosure is directed to an improved composite construction in game racquets. It can be used for racquetball, squash, tennis and other sports which utilize a stringed racquet.

Laminated wood racquets are believed outdated. Extruded metal frames utilizing aluminum and plastic inserts are disclosed in U.S. Pat. No. 4,066,260 of the same inventor. Such devices are exposed to rather rugged use and, therefore, must be fairly rigid. Even the gentlemanly play of racquet sports imparts fairly severe shock stresses to a racquet. There is, therefore, a tendency to deform the racquet frame during use. Deformation as a result of the continual pounding which occurs in use is resisted by the frame structure, provided it has the ability to absorb the energy that is created in use. When the racquet strikes a ball, the energy stored in the swinging racquet and the arm of the player places a substantial bending stress in the frame.

The referenced patent is directed to a composite, extruded metal channel which encloses or houses an extruded central core formed of plastic materials. The central core is attached to the surrounding metal channel by a suitable adhesive, thereby achieving a bonded material. This is said to provide improved strength and durability. The present invention is patentably different from the referenced disclosure. This invention is directed to a racquet which is much easier to manufacture and is made in a different manner.

Costs of manufacture are surprisingly high for molded composite material tennis racquets of equal playing characteristics. It is difficult to form racquets from a metal conduit or channel which is first bent into some particular shape and which is also bonded to the plastic core.

The apparatus of this disclosure is relatively easier to construct. One of the benefits of the present structure is the ability to form the laminated structure with reduced equipment costs. It is relatively more difficult and ordinarily more expensive in equipment and labor to bend channel material into the shape of a frame. The manufacturing cost of composite racquets known heretofore have been largely devoted to overcoming these fabrication difficulties. In particular, relatively greater manufacturing costs have been devoted to expensive molds. The present invention avoids the necessity of constructing that kind of mold. Rather, the aluminum section in this disclosure is first shaped to the desired frame size and shape; thereafter, open passages in the channel material are filled with the unset laminate material. The next step in the fabrication of the apparatus is to set the laminate material as by a combination of elevated pressure, elevated temperature and the passage of significant time.

This disclosure thus accomplishes composite material tennis racquet fabrication at a reduced cost and still has great frame structural integrity and ability to withstand the shock loading which occurs during use.

One feature of the present disclosure is to provide an extruded metal frame which supports multiple layers of laminated material. The laminated material is received in the extruded frame, thereby avoiding the necessity for more expensive molds. The composite frame is formed with a central metal webbing enabling quick and easy drilling of holes to string the racquet. The composite constructed frame has structural integrity enabling the frame to withstand the shock of rigorous use.

BRIEF SUMMARY OF THE DISCLOSURE

This disclosure is directed both to a method of fabrication and a completed racquet. The method of fabrication contemplates a first step of forming an extruded channel which is then bent to shape. The extruded channel defines a pair of parallel, lengthwise cavities, one on each side. A laminate layer (prior to setting) is placed in these cavities. After the extruded channel is bent to shape using conventional bending techniques, a laminate material is placed in each cavity in the channel after the channel has been cleaned. The laminate material is thereafter clamped in the channels. The application of pressure by way of clamping and curing through either elevated temperature or curing time sets the resin in the laminate material to complete the frame. Thereafter, the apparatus is cleaned, and the racquet is finished by installing grommets, padding strips and the like, along with a handle. This completes the construction of the racquet.

BRIEF DESCRIPTION OF THE DRAWINGS

So that the manner in which the above recited features, advantages and objects of the invention, as well as others which will become apparent, are attained and can be understood in detail, a more particular description of the invention briefly summarized above may be had by reference to the embodiments thereof illustrated in the appended drawings, which drawings form a part of this specification. It is to be noted, however, that the appended drawings illustrate only typical embodiments of the invention and are not to be considered limiting of its scope, for the invention may admit to other equally effective embodiments.

FIG. 1 discloses a racquet formed in accordance with the teachings of the present invention having the preferred form of a racquet for use in racquetball;

FIG. 2 discloses details of construction of one form of the handle configuration of the racquet;

FIG. 3 shows a cross-sectional shape of a first form of extrudate material serving as a channel for fabrication in accordance with the present invention;

FIG. 4 is an alternate form of channel material to the structure shown in FIG. 3;

FIG. 5 is a strip insert to be temporarily supported in the channel material of FIGS. 3 and 4;

FIG. 6 is a cross-sectional view of the channel material shown in FIG. 4 showing in cross section the installation of laminate material therein;

FIG. 7 shows a process step to be contrasted with FIG. 6 showing a mechanism for forming the laminate strips with the channel;

FIG. 8 shows the next step in progression of the manufacture of the present apparatus; and FIG. 9 shows the completed frame formed of a channel and laminated material attached thereto.

DETAILED DESCRIPTION OF THE ILLUSTRATED EMBODIMENT

This apparatus is directed to a racquet for use in various racquet sports such as tennis, squash or racquetball. A racquet is identified in FIG. 1 of the drawings by the numeral 10. The racquet 10 has a frame made of composite or layered materials as taught by this disclosure. The racquet 10 incorporates a channel formed of metal which is bent into an oval frame 11. The channel will be described in greater detail hereinafter. Typically, it is an aluminum channel formed to a cross-sectional profile as will be explained.

The channel incorporates a laminated plastic strip 12 which is a shaped, plastic fiber reinforced strip more specifically described below. The channel is formed into an oval shape conforming with regulations for the sport which oval shape encloses a stringed area to be constructed at 13. The strings are not shown in the drawings for the sake of clarity. The device may incorporate a throat 14 which is abbreviated by providing an opening at 15. The throat 14 is attached to the frame within the oval by means of suitable bolts or screws 16. The shaped metal channel with laminate material is formed into a pair of legs which are adjacent to one another and which are identified by the numeral 17 extending into a leather wrapped handle 18. The device terminates at a safety loop 19.

The legs 17 are shown in FIG. 2 of the drawings. There, the handle 18 is formed of selected components which include a straight channel piece 20, an opposing similar channel piece 21 and pins 22 which join them together. The pins are positioned through parallel drilled holes. The pins pass through the drilled holes and through the legs 17 of the channel material which forms or defines the racquet. The oval is located at the end of the legs 17 where they form an encircling structure. While this handle construction is preferred, other handles can be used.

By altering scale and proportion, the apparatus described to this juncture can be any type of racquet. A tennis racquet can be constructed. Typically, a tennis racquet has a longer handle with a short handle grip. This construction can be readily obtained. The handle grip is shown in these drawings extending fairly close to the oval as occurs in the construction of racquetball equipment. By contrast, different proportions will yield a different racquet. Notwithstanding this, the present invention finds application in this disclosed structure to enable fabrication of a racquet which is able to stand the stress of vigorous use.

Attention is next directed to FIGS. 3 and 4. FIG. 3 shows a first channel profile identified by the numeral 30. FIG. 4 shows an alternate form at 32. The sectional views depict two or three important features which are common to both. Firstly, both profiles depict left and right lengthwise open cavities for receiving the laminate material to be described. Because the two are fairly similar, they will be described by the reference numeral 34 for the left cavity and the reference numeral 35 for the right cavity. The same numeral is applied to each cross-sectional profile depicted in FIGS. 3 and 4. The cavities 34 and 35 extend lengthwise of the structure to receive the laminate material. They are separated from one another by a central web 36 which is duplicated with the embodiment 32, but this poses no particular problem. The web 36 is the location at which holes are drilled to string the racquet. The drilled holes support strings which fill the oval 13 in a known manner. The strings are placed under tension, thereby loading the frame. The frame which is formed of the composite material closes in a circle around the oval space 13, thereby imparting shape or profile to the stringed surface.

FIG. 5 shows a rigid or semirigid insert 37 which is notched periodically and is slipped into the lengthwise cavities 34 and 35. So to speak, it props the cavity open prior to bending so that the walls which define the cavity maintain a parallel relationship during bending. Bending to the form shown in FIG. 1 then reshapes the straight aluminum stock channel material into the desired shape. After reshaping, the insert 37 is removed from the lengthwise cavities. The frame at this juncture has the shape depicted in FIG. 1, except the handle 18 has not been attached, and the two handle members 17 are adjacent to one another, but they are not necessarily in contact with one another. They might spread slightly before they are attached by positioning pins through them and putting the handle grips on. The next step in the fabrication of the present invention is to insert a flexible plastic strip in each cavity. The plastic strip is typically a body of epoxy having graphite or fiberglass fibers in it. It is typically soft or tacky. The extruded section depicted in FIGS. 3 and 4 defines lengthwise cavities which accept the laminate material. The laminate material is laid in each cavity, typically applied by hand. It is supplied in ribbons and is, therefore, easily installed in the lengthwise cavity by hand in the tacky state. While it will eventually be form-fitted by subsequent manufacturing steps, it is applied only loosely and is shown in FIG. 6 in this form. FIG. 6 is a cross-sectional view of the extruded section 32 receiving a first laminate strip 38 on the left and an identical laminate strip 39 on the right. They are roughly depicted in FIG. 6; the precise cross-sectional shape is generally variant inasmuch as the laminate material is in a plastic state. The plastic state of the material enables it to be attached rather rapidly to the cavities. It is tacky and has slight adhesive holding or grip with the aluminum channel material.

There are a number of laminate materials available which would be suitable for use in this disclosure. For many, it is necessary to first clean the aluminum stock material. Cleaning typically requires chemical or mechanical cleaning. Cleaning can be accomplished by dipping the racquet frame into a bath of cleaning material to remove surface grease. For instance, carbon tetrachloride will typically cut most surface greases. Other methods of cleaning the surface to improve the grip between the laminate layer and the aluminum stock can be used.

FIG. 7 of the drawings shows the extruded section 30 with the laminate material located in both cavities. A form is positioned against the stock. The form is identified by the numerals 41 and 42. It is a pair of opposing dies which are pushed together, the dies fitting snugly within the edges of the cavity. The dies impact the epoxy material. The forms 41 and 42 are pushed toward one another. As they are pushed toward one another, they compress the tacky material. They make it seat in the channel. Once seated, the forms force the tacky epoxy material to flow to form a profile mating or matching the cavities. This profile is achieved on the application of pressure during the setting of the epoxy material. The epoxy material, while supplied in a tacky state, is thermosetting as, for instance, in the use of a catalyst applied to the epoxy. The catalyst, in conjunction with heat, time, or both, causes the epoxy to cure, forming a laminate layer so that the frame of the racquet is a composite construction.

After curing has occurred, the dies are pulled away from the laminate or sandwiched material. On removal of the dies, the shape or profile of the completed racquet can then be observed. At this juncture, it has been shaped to resemble the completed racquet, the two handles 17 extending freely and approximately parallel to one another. If they open up by a few degrees, this poses no problem inasmuch as they can be clamped together thereafter on assembly of the handle. Relative ease of achieving this step can be obtained by coating the dies 41 and 42 with Teflon. This avoids mold release problems typically occurring where the molded material temporarily adheres to the mold.

The structure that is completed to this stage is next shown in FIG. 8 of the drawings, where the numeral 44 identifies the completed laminate structure in cross section. It will be observed that an extra shoulder 45 is found on the intermediate stage of fabrication. The shoulder or lip 45 is surplusage and can thereafter be removed by grinding or cutting. It is typically trimmed and smoothed so that it is reduced in height. It is generally unnecessary for the lip 45 to extend substantially beyond the lamination layer that has now been completed adjacent to the lip.

FIG. 9 shows the completed profile of FIG. 8 with a cosmetic cap strip 46 inserted into the lengthwise cavity. The cosmetic strip 46 is a strip of plastic material which typically is colored to provide a decorative strip. It is applied over the laminate material for decorative purposes. It can be applied before or after curing of the laminate. The lip 45 immediately adjacent to it can thereafter be folded over or removed as required.

At this stage, the central web is drilled. Strings are placed in the holes which are drilled through it, and completion of the racquet then proceeds. The strings can be protected by installing grommets, either singly or in strips. Continuous plastic bumpers bonded to the outside of the frame can also be incorporated. The throat, if used, and handle construction can also be completed. Typically, the frame is shaped to the final form in that the throat is installed and the handle completed prior to stringing. However, the grommets for stringing can be installed first.

Playing characteristics of the racquet fabricated in this manner are altered and improved by the stiffness and energy absorbing characteristics of the composite construction. The ability to receive shock is enhanced through the incorporation of the laminate layer. Moreover, construction costs are surprisingly reduced. Construction costs, being reduced, enable the fabrication of a higher quality racquet and permit more of the cost to be allocated to the strings, grip and other components.

While the foregoing is directed to the preferred embodiment, the scope of the present invention is determined by the claims which follow.

I claim:

1. A method of making a racquet comprising the steps of:

(a) providing an extruded, substantially straight lengthwise, metal channel having cavities extending therealong;

(b) bending the metal channel into a desired curved form of a racquet frame having a stringing surface on the outer surface and side faces having cavities and wherein the ends of the metal channel extend into a handle on the racquet;

(c) positioning a continuous lengthwise strip of uncured, pliable laminate material in at least one of said cavities of the extruded curved metal channel; and (d) curing the cavity located laminate material to form laminations of the plastic material to the metal channel.

2. The method of claim 1 including the step of drilling holes in the metal channel at locations where the holes pass through the metal channel, but not through the laminate formed therewith, wherein the holes are adapted to receive strings for the stringing surface.

3. The method of claim 1 including the step of clamping the two ends of the metal channel together to define a handle which encloses the two ends.

4. The method of claim 1 including the preliminary step of forcing the uncured plastic strip into facial contact against the cavity within the metal channel to require that the plastic strip takes on the profile of the cavity where contact is made.

5. The method of claim 1 further including the step of attaching a length of flexible plastic covering material in the cavity adjacent to the laminate material therein.

6. The method of claim 1 wherein said cavity includes sidewalls defining an overhanging lip which lip is trimmed after curing.

7. A method of making a racquet which comprises the steps of:

(a) providing an elongate substantially straight metal channel having a lengthwise cavity therein;

(b) bending the metal channel to a curved form having a stringing surface on the outer surface and the cavity being in a side face preliminary to completion into a racquet frame;

(c) installing an uncured plastic laminate strip in the cavity of the metal channel;

(d) applying pressure to the uncured laminate strip within the cavity prior to curing and thereafter curing the laminate strip where the pressure is applied by means of a die inserted into the cavity;

(e) removing the die after curing of the laminate strip; and (f) assembling the racquet frame now formed of a laminated metal channel and cured laminate strip within the cavity.

8. The method of claim 7 including the step of drilling holes in the metal channel at locations where the holes pass through the metal channel, but not through the laminate strip formed therewith, wherein the holes are adapted to receive strings for the stringing surface.

9. The method of claim 7 including the step of clamping the two ends of the metal channel together to define a handle which encloses the two ends.

10. The method of claim 7 including the preliminary step of forcing the uncured plastic laminate strip into facial contact against the cavity of the metal channel to require that the plastic laminate strip take on the profile of the cavity where contact is made.

* * * * *